US008081143B2

(12) United States Patent
Cho

(10) Patent No.: US 8,081,143 B2
(45) Date of Patent: Dec. 20, 2011

(54) PLASMA DISPLAY APPARATUS

(75) Inventor: Janghwan Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 731 days.

(21) Appl. No.: 11/947,653

(22) Filed: Nov. 29, 2007

(65) Prior Publication Data

US 2008/0122817 A1 May 29, 2008

(30) Foreign Application Priority Data

Nov. 29, 2006 (KR) ..... 10-2006-0119391

(51) Int. Cl.
*G09G 3/28* (2006.01)

(52) U.S. Cl. ..... 345/60; 315/169.4

(58) Field of Classification Search ..... 345/60–72, 345/204, 690–692; 315/169.4
See application file for complete search history.

(56) References Cited

U.S. PATENT DOCUMENTS 5,835,072 A * 11/1998 Kanazawa ..... 345/60
2005/0156824 A1 7/2005 Okamoto
2006/0152167 A1 7/2006 Takagi et al.

FOREIGN PATENT DOCUMENTS

EP 1 524 643 4/2005
EP 1 736 955 12/2006
KR 10-0208919 7/1999
KR 10-2001-0000955 1/2001
KR 10-2006-0067887 6/2006

OTHER PUBLICATIONS

European Search Report in Application No. 07254630.2-2205, mailed Jul. 20, 2009, 7 pages.

* cited by examiner

*Primary Examiner* — Stephen Sherman
(74) *Attorney, Agent, or Firm* — Fish & Richardson P.C.

(57) ABSTRACT

A plasma display apparatus is disclosed. The plasma display apparatus includes a plasma display panel including an address electrode, and a data driver. The data driver supplies a data signal having at least three voltage levels to the address electrode during an address period using different voltages received from first and second constant voltage sources.

19 Claims, 8 Drawing Sheets

PLASMA DISPLAY APPARATUS

This application claims the benefit of Korean Patent Application No.10-2006-0119391 filed on Nov. 29, 2006, which is hereby incorporated by reference.

BACKGROUND OF THE DISCLOSURE

1. Field of the Disclosure

This document relates to a plasma display apparatus.

2. Description of the Related Art

A plasma display apparatus includes a plasma display panel and a driver for driving the plasma display panel.

The plasma display panel has the structure in which barrier ribs formed between a front panel and a rear panel forms unit discharge cell or a plurality of discharge cells. Each discharge cell is filled with an inert gas containing a main discharge gas such as neon (Ne), helium (He) or a mixture of Ne and He, and a small amount of xenon (Xe). The plurality of discharge cells form one pixel. For example, a red (R) discharge cell, a green (G) discharge cell, and a blue (B) discharge cell form one pixel. When the plasma display panel is discharged by applying a high frequency voltage to the discharge cell, the inert gas generates vacuum ultraviolet rays, which thereby cause phosphors formed between the barrier ribs to emit light, thus displaying an image. Since the plasma display apparatus can be manufactured to be thin and light, it has attracted attention as a next generation display device.

SUMMARY OF THE DISCLOSURE

This document provides a plasma display apparatus capable of minimizing power consumption by lowering a driving voltage.

This document provides a plasma display apparatus capable of improving the reliability by reducing a load applied to a data driving integrated circuit.

In one aspect, a plasma display apparatus comprises a plasma display panel including an address electrode, and a data driver that supplies a data signal having at least three voltage levels to the address electrode during an address period using different voltages received from first and second constant voltage sources.

In another aspect, a plasma display apparatus comprises a plasma display panel including an address electrode, and a data driver that supplies a data signal to the address electrode during an address period, the data driver including a first data driver and a second data driver, the first data driver supplying a first voltage received from a first constant voltage source or a ground level voltage received from a ground level voltage source to the second data driver during the address period, the second data driver supplying the first voltage or the ground level voltage received from the first data driver or a sum of the first voltage or the ground level voltage and a second voltage received from a second constant voltage source to the address electrode.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
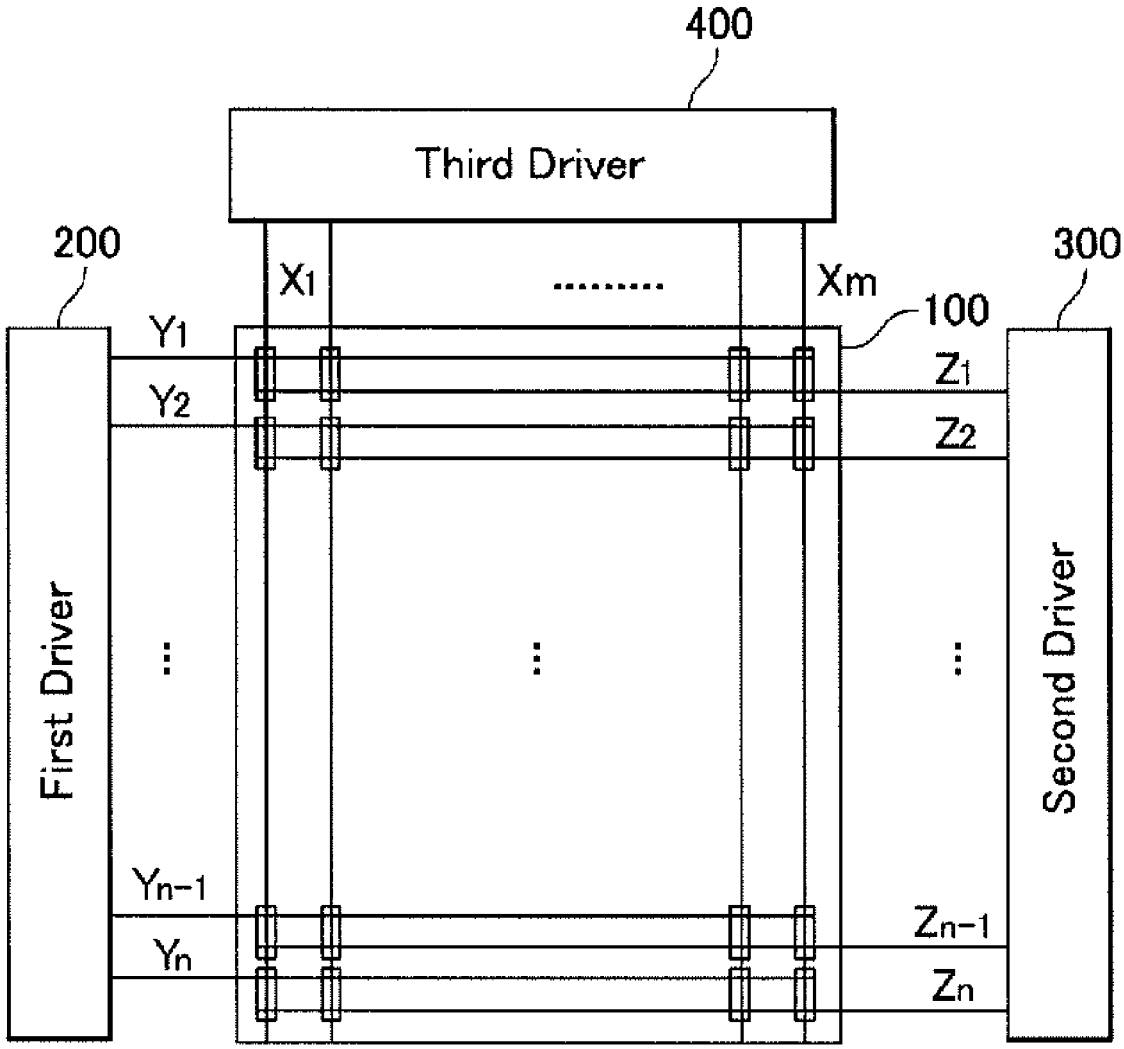
FIG. 1 shows a plasma display apparatus according to an exemplary embodiment.

FIG. 1 shows a plasma display apparatus according to an exemplary embodiment.

As shown in FIG. 1, the plasma display apparatus according to the exemplary embodiment includes a plasma display panel 100, a first driver 200, a second driver 300, and a third driver 400.

The plasma display panel 100 includes a front panel (not shown) and a rear panel (not shown) which coalesce with each other at a given distance. The plasma display panel 100 includes scan electrodes Y1 to Yn, sustain electrodes Z1 to Zn, and address electrodes X1 to Xm.

The first driver 200 supplies a reset signal to the scan electrodes Y1 to Yn during a reset period so as to uniformly accumulate wall charges inside discharge cells. The first driver 200 supplies a scan signal to the scan electrodes Y1 to Yn during an address period so as to select the discharge cells to be turned on. The first driver 200 supplies a sustain signal to the scan electrodes Y1 to Yn during a sustain period so as to generate a sustain discharge inside the selected discharge cell.

The second driver 300 supplies a sustain bias signal to the sustain electrodes Z1 to Zn during a set-down period and the address period. The second driver 300 supplies a sustain signal to the sustain electrodes Z1 to Zn during the sustain period.

The third driver 400 receives data mapped for each subfield by a subfield mapping circuit (not shown) after being inverse-gamma corrected and error-diffused through an inverse gamma correction circuit (not shown) and an error diffusion circuit (not shown), or the like. The third driver 400 samples and latches the mapped data in response to a data timing control signal supplied from a timing controller (not shown), and then supplies the latched data to the address electrodes X1 to Xm.

The third driver 400 includes a data driver that supplies a data signal having at least three voltage levels due to voltages received from first and second constant voltage sources to the address electrodes X1 to Xm.

Figure 2:
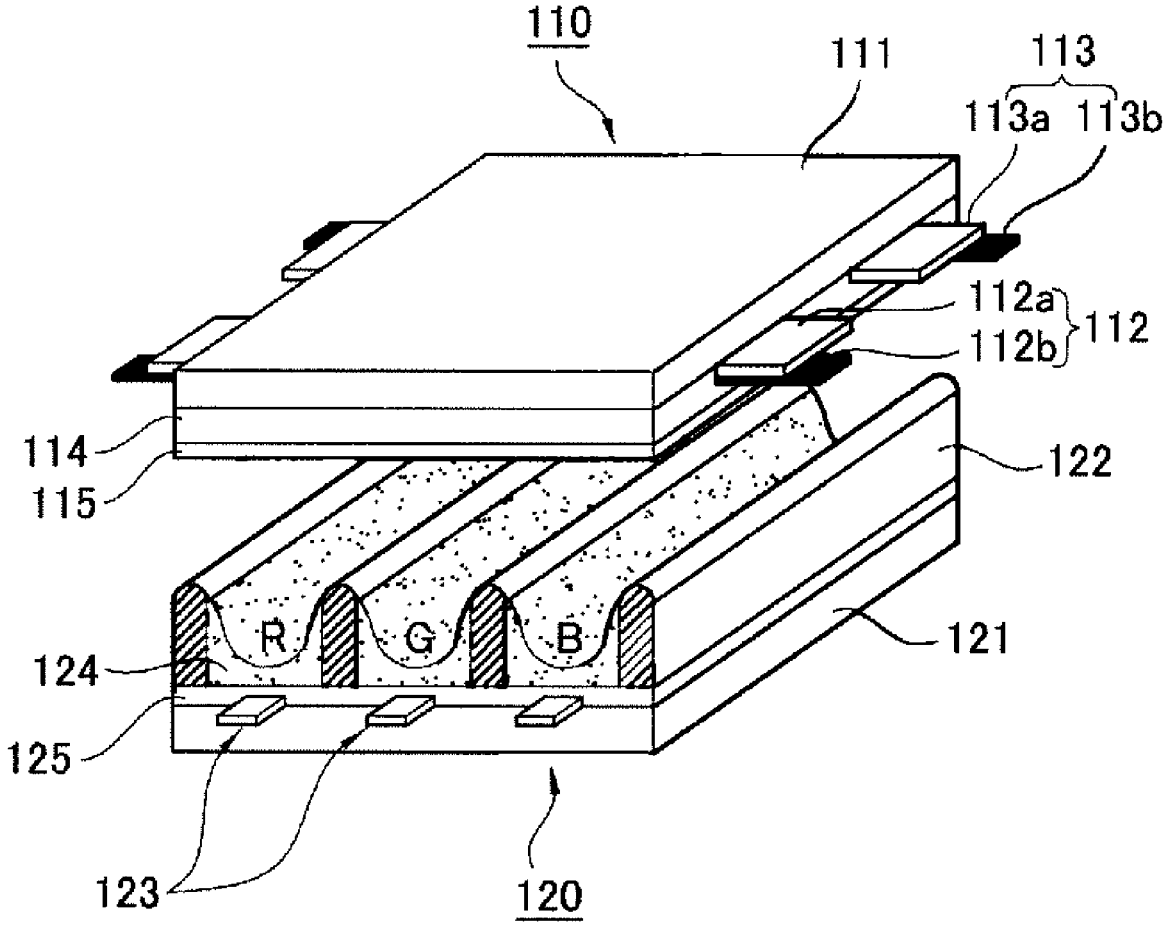
FIG. 2 shows a structure of a plasma display panel of the plasma display apparatus according to the exemplary embodiment.

FIG. 2 shows a structure of a plasma display panel of the plasma display apparatus according to the exemplary embodiment.

As shown in FIG. 2, the plasma display panel 100 includes a front panel 110 and a rear panel 120 which coalesce with each other at a given distance therebetween. The front panel 110 includes a front substrate 111 on which a scan electrode 112 and a sustain electrode 113 are positioned parallel to each other. The rear panel 120 includes a rear substrate 121 on which an address electrode 123 is positioned to intersect the scan electrode 112 and the sustain electrode 113.

The scan electrode 112 and the sustain electrode 113 generate a mutual discharge therebetween in a discharge cell and maintain a discharge of the discharge cell.

The scan electrode 112 and the sustain electrode 113 each include transparent electrodes 112*a* and 113*a* made of a transparent material, e.g., indium-tin-oxide (ITO) capable of efficiently emitting light generated in the discharge cell to the outside, and bus electrodes 112*b* and 113*b* made of a metal material such as silver (Ag) capable of securing the driving efficiency.

An upper dielectric layer 114 covering the scan electrode 112 and the sustain electrode 113 is positioned on the front substrate 111 on which the scan electrode 112 and the sustain electrode 113 are positioned. The upper dielectric layer 114 limits discharge currents of the scan electrode 112 and the sustain electrode 113 and provides electrical insulation between the scan electrode 112 and the sustain electrode 113.

A protective layer 115 is positioned on an upper surface of the upper dielectric layer 114 to facilitate discharge conditions. The protective layer 115 may be formed of a material with a high secondary electron emission coefficient, e.g., magnesium oxide (MgO).

The address electrode 123 positioned on the rear substrate 121 applies a data signal to the discharge cell.

A lower dielectric layer 125 covering the address electrode 123 is positioned on the rear substrate 121 on which the address electrode 123 is positioned.

Barrier ribs 122 are positioned on the lower dielectric layer 125 to partition the discharge cells. A phosphor 124 emitting visible light for an image display during an address discharge is positioned inside the discharge cells partitioned by the barrier ribs 122. The phosphor 124 may include red (R), green (G) and blue (B) phosphors.

The plasma display panel according to the exemplary embodiment is discharged by applying driving signals to the scan electrode 112, the sustain electrode 113 and the address electrode 123, thereby displaying an image inside the discharge cells.

Since FIG. 1 illustrated only an example of the plasma display panel applicable to the exemplary embodiment, the exemplary embodiment is not limited thereto.

Figure 3:
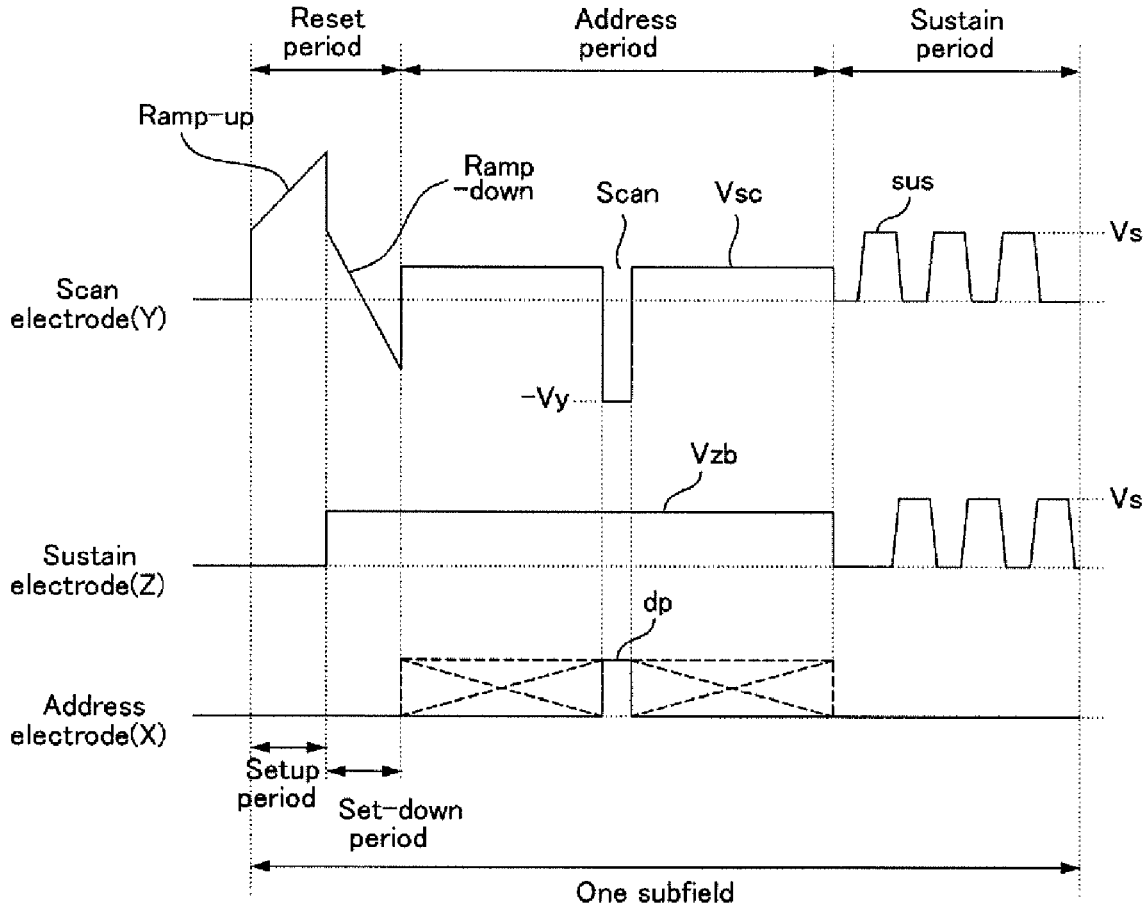
FIG. 3 is a diagram for explaining an operation of the plasma display apparatus according to the exemplary embodiment.

FIG. 3 is a diagram for explaining an operation of the plasma display apparatus according to the exemplary embodiment.

As shown in FIG. 3, the first driver 200, the second driver 300 and the third driver 400 of FIG. 1 may supply driving signals to the scan electrode Y, the sustain electrode Z and the address electrode X during at least one of a reset period, an address period, and a sustain period.

The reset period is divided into a setup period and a set-down period. During the setup period, the first driver 200 may supply a rising signal (Ramp-up) to the scan electrode Y. The rising signal (Ramp-up) generates a weak dark discharge inside the discharge cells of the whole screen. Hence, wall charges of a positive polarity are accumulated on the sustain electrode Z and the address electrode X, and wall charges of a negative polarity are accumulated on the scan electrode Y.

During the set-down period, the first driver 200 may supply a falling signal (Ramp-down), which falls from a positive voltage level lower than a highest voltage of the rising signal (Ramp-up) to a given voltage level lower than a ground level voltage GND, to the scan electrode Y, thereby generating a weak erase discharge inside the discharge cells. Hence, wall charges excessively accumulated inside the discharge cells are erased, and the remaining wall charges are uniformly distributed inside the discharge cells to the extent that an address discharge can stably occur.

The second driver 300 supplies a sustain bias voltage Vzb to the sustain electrode z during the set-down period and the address period. The sustain bias voltage Vzb reduces a voltage difference between the sustain electrode Z and the scan electrode Y, thereby preventing the generation of an erroneous discharge.

During the address period, the first driver 200 supplies a scan signal (Scan) of a negative polarity falling from a scan bias voltage Vsc to the scan electrode Y. The data driver of the third driver 400 supplies a data signal (dp) of a positive polarity corresponding to the scan signal (Scan) to the address electrode X.

The data signal (dp) of the positive polarity may have at least three voltage levels due to voltages received from the first and second constant voltage sources. In other words, a case where the data signal (dp) is supplied using two voltage sources can have the smaller power consumption than a case where the data signal (dp) is supplied using one voltage source. Hence, an internal pressure applied to switch elements can be minimized and heat generated in the switch elements can be reduced.

As a voltage difference between the scan signal (Scan) and the data signal (dp) is added to a wall voltage produced during the reset period, an address discharge occurs inside the discharge cells to which the data signal (dp) is applied. Wall charges are distributed inside the discharge cells selected by performing the address discharge to the extent that when a sustain voltage Vs is applied, a discharge occurs.

During the sustain period, the first driver 200 and the second driver 300 supply sustain signals (sus) to the scan electrode Y and the sustain electrode Z, respectively. As a wall voltage inside the discharge cells selected by performing the address discharge is added to the sustain signal (sus), every time the sustain signal (sus) is applied, a sustain discharge occurs between the scan electrode Y and the sustain electrode Z.

An erase period during which the remaining wall charges after the sustain discharge are erased may be added after the sustain period. Further, a pre-reset period during which wall charges are stably distributed may be added prior to the reset period.

Although the first driver 200 and the second driver 300 operate independently of each other in FIG. 3, the first driver 200 and the second driver 300 may operate in the form of an integrated driver.

Figure 4:
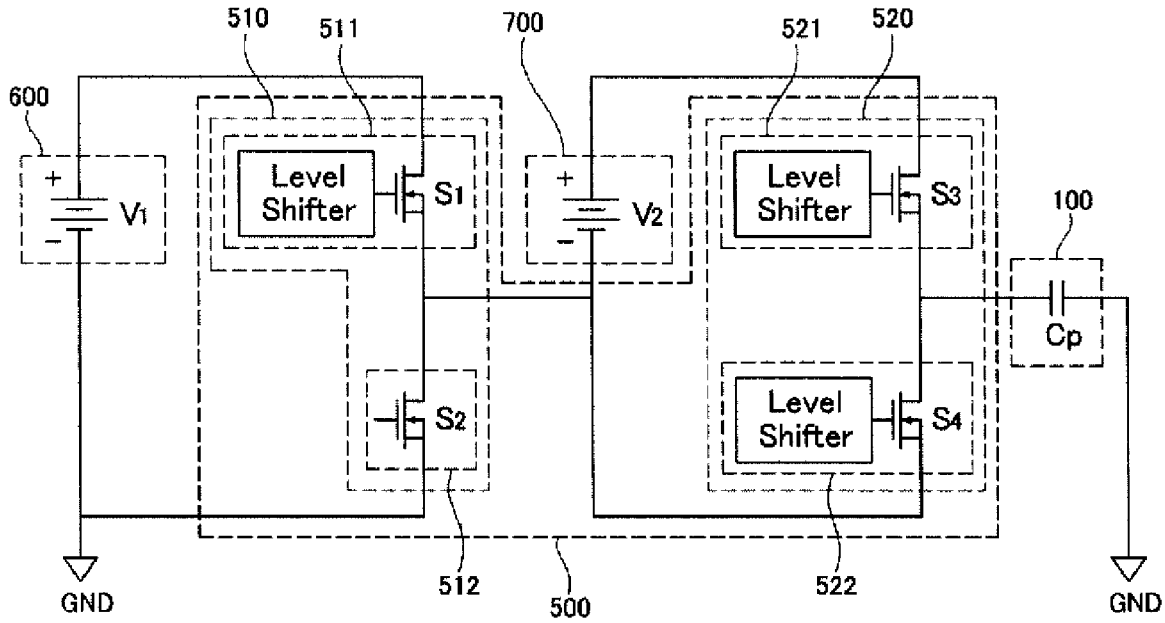
FIG. 4 is a circuit diagram of a data driver of the plasma display apparatus according to the exemplary embodiment.

FIG. 4 is a circuit diagram of a data driver of the plasma display apparatus according to the exemplary embodiment.

As shown in FIG. 4, a data driver 500 supplies a data signal to the address electrode X during an address period. The data signal may have at least three voltage levels due to voltages received from first and second constant voltage sources.

The data driver 500 includes a first data driver 510 and a second data driver 520. The first data driver 510 supplies a first voltage V1 received from a first constant voltage source 600 or a ground level voltage received from a ground level voltage source GND to the second data driver 520 during the address period.

The second data driver 520 supplies the first voltage V1 or the ground level voltage to the address electrode X, or supplies a sum of the first voltage or the ground level voltage and a second voltage V2 received from a second constant voltage source 700 to the address electrode X during the address period.

Since the two data drivers 510 and 520 included in the data driver 500 supply voltages to the address electrode X using voltages received from the two different voltage sources 600 and 700, degree of freedom in voltage can increase. The degree of freedom in voltage means that a use range of voltage level widens using a low voltage. Since switching elements of the first data driver 510 and switching elements of the second data driver 520 can produce various different voltages, the data signal (dp) having the same highest voltage level can be produced due to the combination of low voltage levels.

The first and second voltages V1 and V2 may be lower than a highest voltage of the data signal (dp). Hence, an internal pressure applied to the switching elements can be reduced, and thus heat generated during the drive can be reduced. The first voltage V1 may be higher than the second voltage V2.

More specifically, since the first voltage is higher than the second voltage V2 and is lower than a highest voltage of the data signal, an address discharge can stably occur using the low voltages V1 and V2. Hence, while an erroneous discharge is prevented, heat generated during the drive can be reduced. The first voltage may range from 35V to 45V, and the second voltage may range from 25V to 35V.

The first data driver 510 includes a first switch unit 511 and a second switch unit 512. The first switch unit 511 is used to supply the first voltage V1 to the second data driver 520, and the second switch unit 512 is used to supply the ground level voltage to the second data driver 520.

The second data driver 520 includes a third switch unit 521 and a fourth switch unit 522. The third switch unit 521 is used to supply a sum of the first voltage V1 or the ground level voltage and the second voltage V2 to the address electrode X. The fourth switch unit 522 is used to supply the first voltage V1 or the ground level voltage to the address electrode X.

One terminal of the first switch unit 511 is electrically connected to the first constant voltage source 600, and the other terminal is electrically connected to one terminal of the second switch unit 512 and the second data driver 520. The other terminal of the second switch unit 512 is electrically connected to the ground level voltage source GND. One terminal of the third switch unit 521 is electrically connected to the second constant voltage source 700, and the other terminal is electrically connected to one terminal of the fourth switch unit 522 and the address electrode. The other terminal of the fourth switch unit 522 is electrically connected to the first data driver 510.

Since the data driver 500 include the plurality of switch units, operations of the first to fourth switch units can form various different voltage paths of the voltages received from the voltage sources. Accordingly, the data signal may have at least three voltage levels. More specifically, the data signal may have the first voltage V1 received from the first constant voltage source 600, the second voltage V2 received from the second constant voltage source 700, a sum of the first voltage V1 and the second voltage V2, and the ground level voltage received from the ground level voltage source GND.

The data driver 500 may be included in one data driving integrated circuit. Because the data driver 500 includes the plurality of switch units, it is easy to form the data driver 500 in the form of an integrated circuit.

Figure 5:
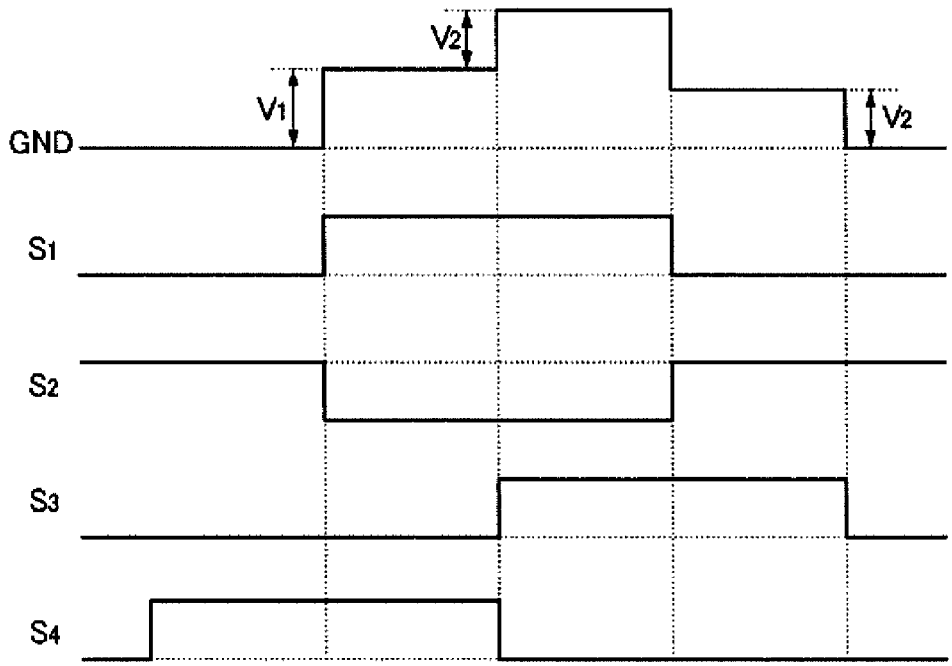
FIG. 5 is a timing diagram of a driving waveform produced by the data driver of FIG. 4.

FIG. 5 is a timing diagram of a driving waveform produced by the data driver 500 of FIG. 4. FIGS. 6A to 6D are circuit diagrams of the data driver 500 depending on the timing diagram of FIG. 5.

As shown in FIG. 5, the data driver 500 supplies a data signal to the address electrode during an address period.

Figure 6A:
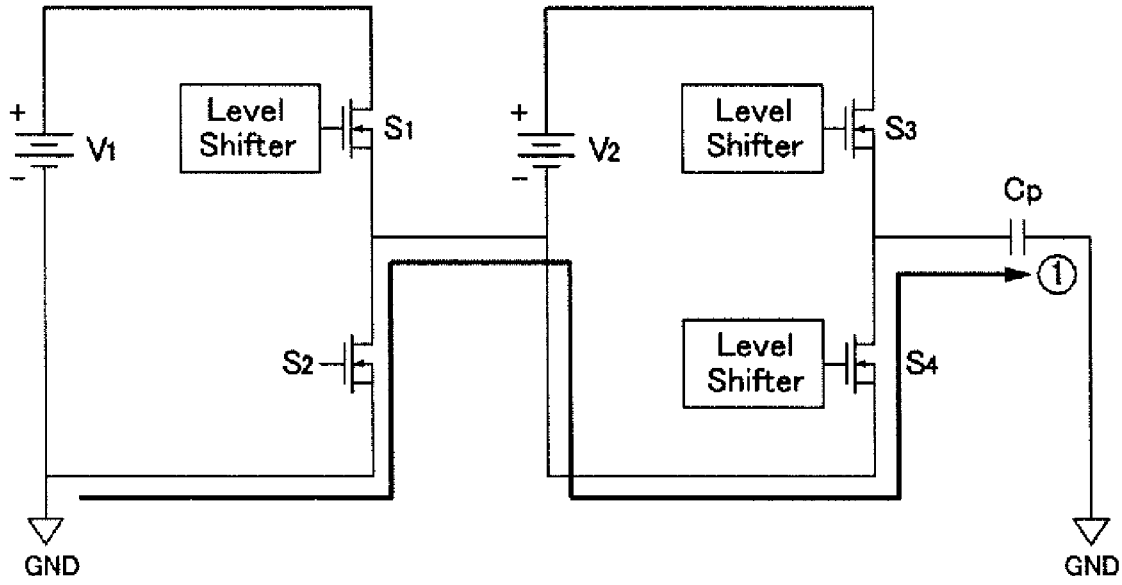
FIGS. 6A to 6D are circuit diagrams of the data driver depending on the timing diagram of FIG. 5.

In FIG. 6A, the second and fourth switch units 512 and 522 are turned on. Hence, a current path ① passing through the ground level voltage source GND, the second switch unit 512, and the fourth switch unit 522 is formed. The ground level voltage is supplied to the address electrode along the current path ①.

Figure 6B:
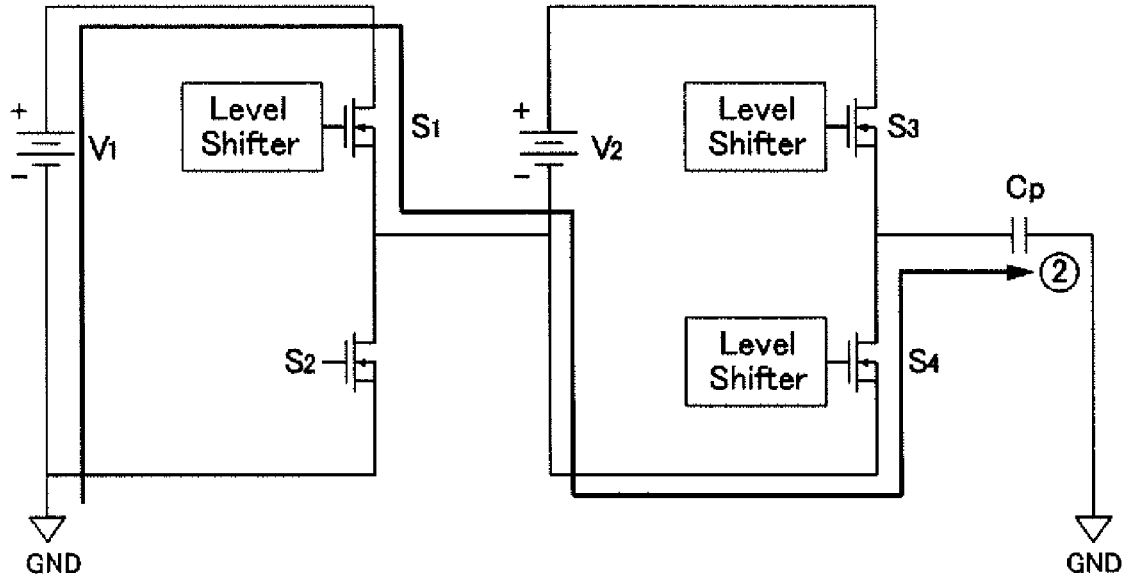

In FIG. 6B, the fourth switch unit 522 remains in a turn-on state and the first switch unit 511 is turned on. Hence, a current path ② passing through the first constant voltage source 600, the first switch unit 511, and the fourth switch unit 522 is formed. The first voltage V1 is supplied to the address electrode along the current path ②.

Figure 6C:
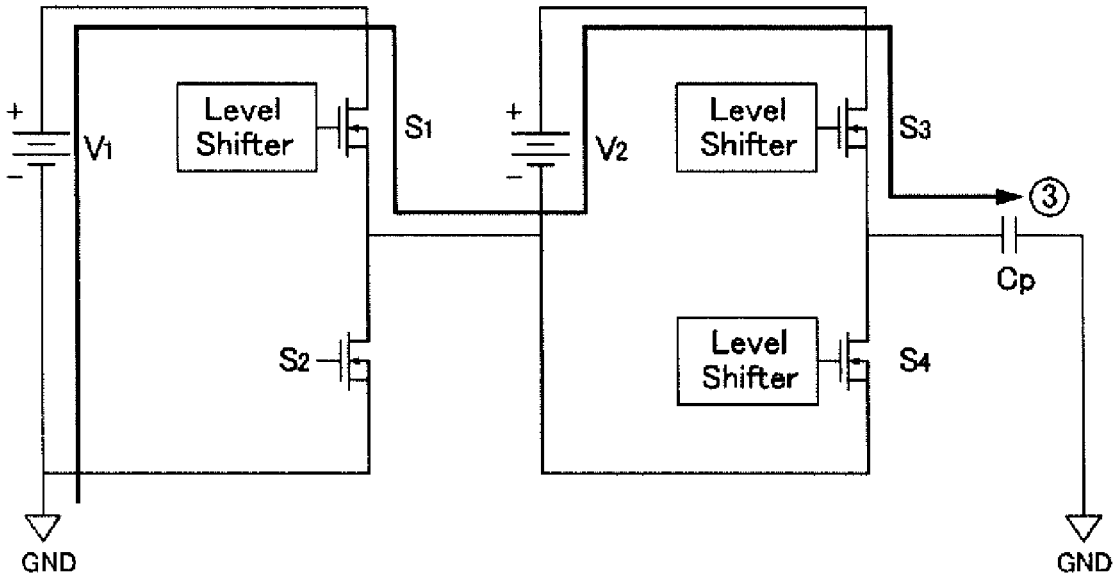

In FIG. 6C, the first switch unit 511 remains in a turn-on state and the third switch unit 521 is turned on. Hence, a current path ③ passing through the first constant voltage source 600, the first switch unit 511, the second constant voltage source 700, and the third switch unit 521 is formed. A highest voltage of the data signal corresponding to a sum of the first voltage V1 and the second voltage V2 is supplied to the address electrode along the current path ③.

The reason why the highest voltage of the data signal is supplied to the address electrode using a sum of the lower voltages is that a loss value of a reactive power generated in the plasma display panel 100 is proportional to the square of a voltage supplied to the address electrode. The reason can be easily understood through the following Equation 1.

$$P=\frac{1}{2}*Cp*V^2*fs \quad \text{[Equation 1]}$$

In the above Equation 1, P indicates a loss value of a reactive power, and V indicates a voltage supplied to the address electrode. The other variables have a fixed value. Therefore, the loss value of the reactive power depends on the voltage supplied to the address electrode. For instance, supposing that a highest voltage of a data signal is 60V, when the data signal is once supplied using one voltage value of 60V, a loss value of a reactive power is 1800. However, when the data signal is supplied using two voltage values of 40V and 30V, a loss value of a reactive power is reduced to 1250. Further, in case of using low voltages having similar values, the loss value of the reactive power can be further reduced. Accordingly, the reactive power loss can be reduced by lowering the voltage of the data signal, and also an internal pressure of the switching element can be reduced.

Figure 6D:
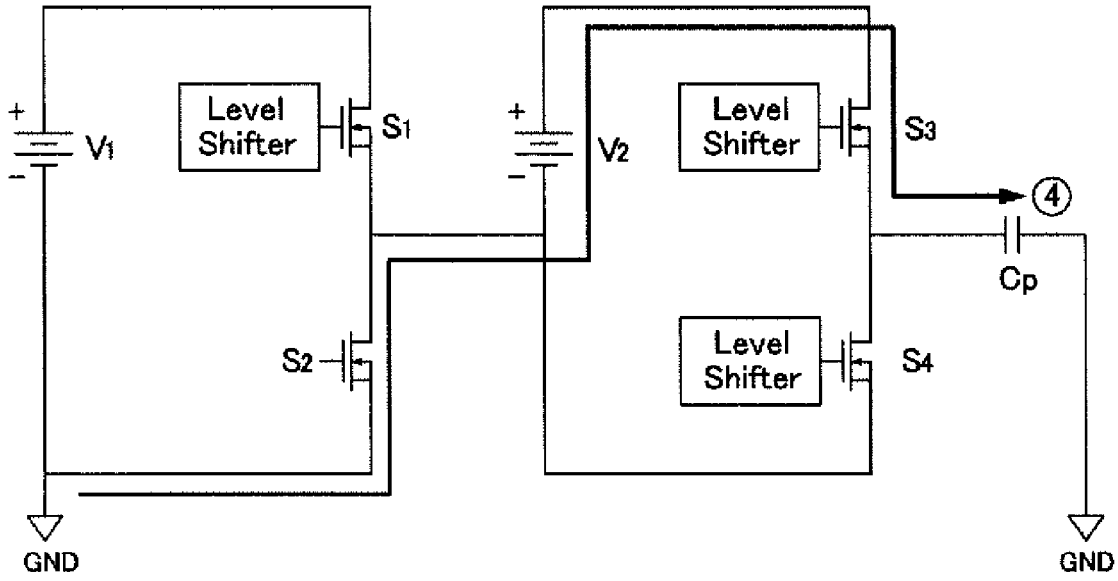

In FIG. 6D, the third switch unit 521 remains in a turn-on state and the second switch unit 512 is turned on. Hence, a current path ④ passing through the second switch unit 512, the second constant voltage source 700, and the third switch unit 521 is formed. The second voltage V2 is supplied to the address electrode along the current path ④.

While FIG. 5 and FIGS. 6A to 6D have illustrated and described the data signal changing from the first voltage V1 to a sum of the first and second voltages V1 and V2 and then the second voltage V2, it is not limited thereto. The first voltage V1 may be substantially equal to the second voltage V2.

The data driver 500 may further include a level shifter capable of adjusting a reference voltage difference which may be generated by performing the above-described operations of the data driver. Each of the first, third and fourth switch units 511, 521 and 522 may include a level shifter except the second switch unit 512 connected to the ground level voltage source GND. The level shifter may shift a reference voltage having the ground level voltage to a reference voltage having a different voltage from the ground level voltage. Hence, various reference voltages may be used.

Figure 7:
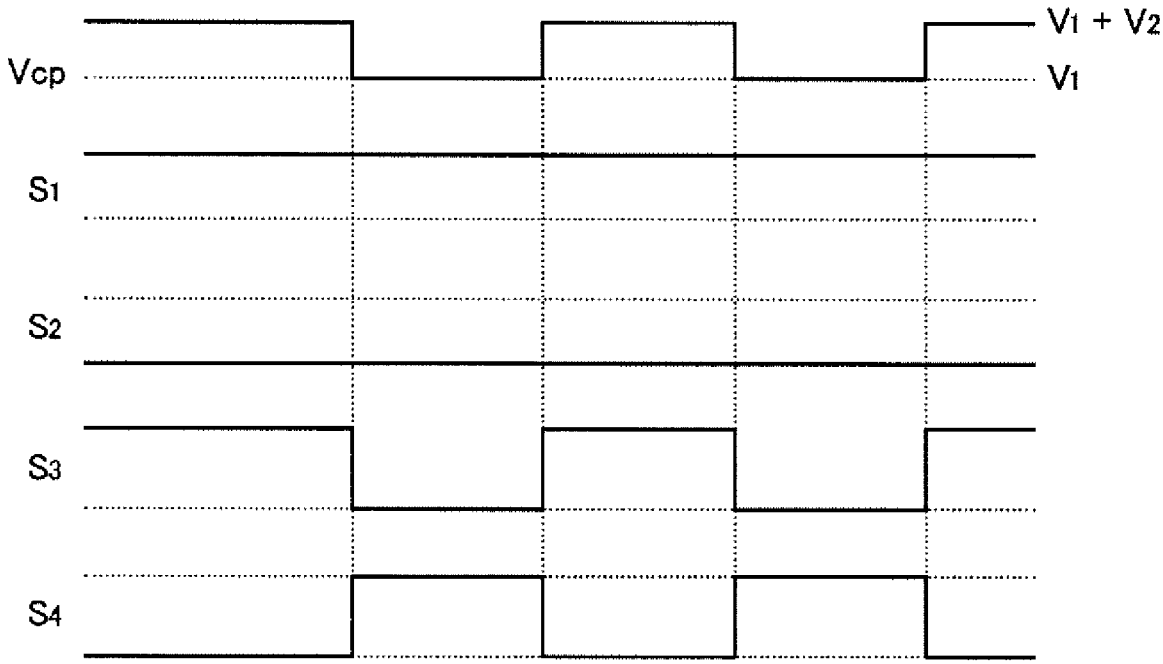
FIG. 7 is another timing diagram of a driving waveform produced by the data driver of FIG. 4.
Figure 8A:
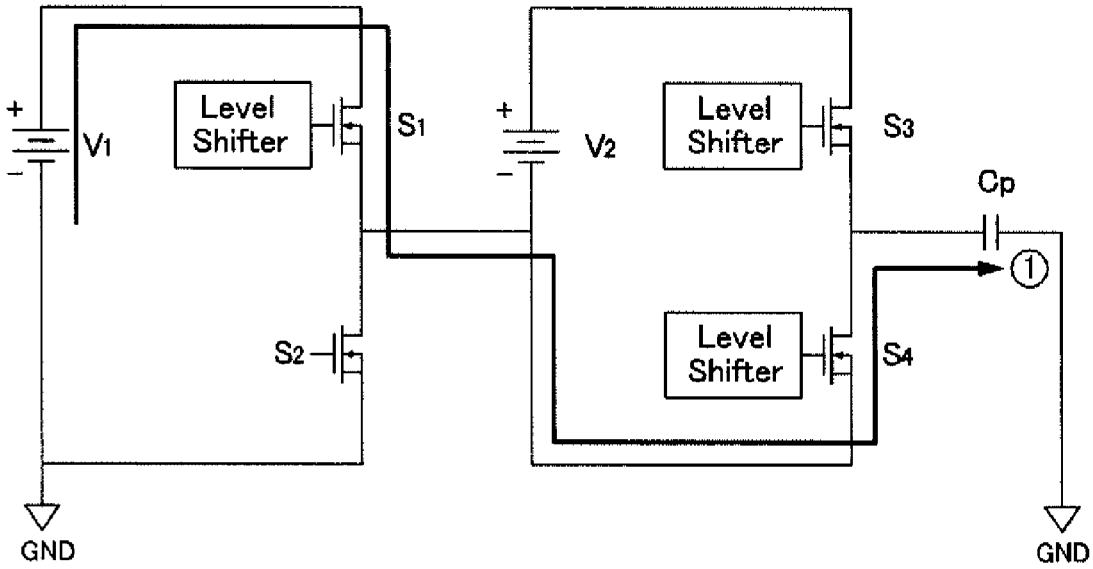
FIGS. 8A and 8B are circuit diagrams of the data driver depending on the timing diagram of FIG. 7.
Figure 8B:
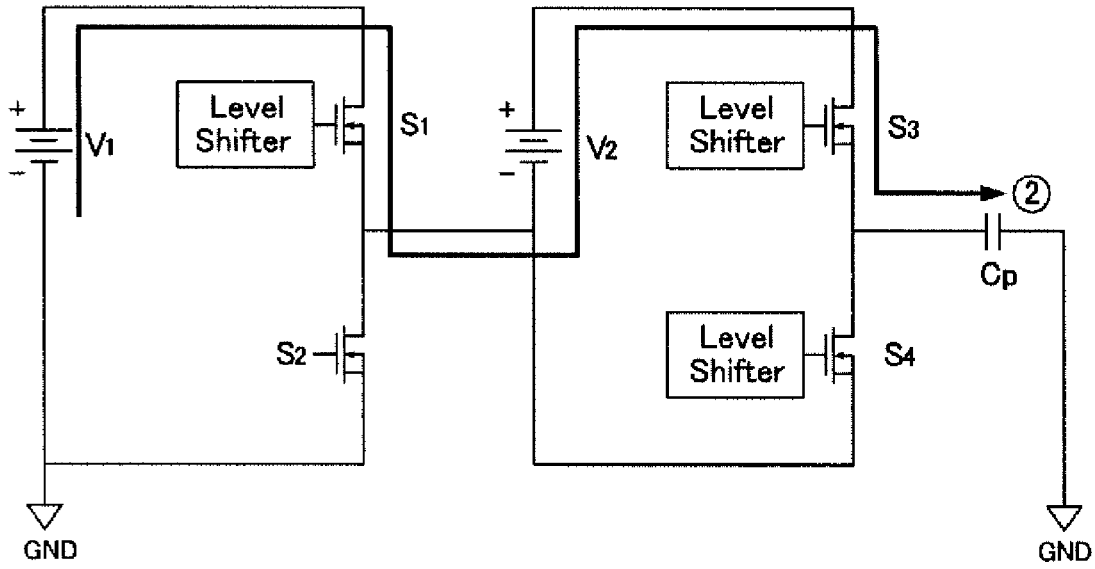

FIG. 7 is another timing diagram of a driving waveform produced by the data driver of FIG. 4. FIGS. 8A and 8B are circuit diagrams of the data driver depending on the timing diagram of FIG. 7.

As shown in FIG. 7, the data driver supplies a data signal to the address electrode during an address period. Structures and components as identical or equivalent to those described in FIG. 5 and FIGS. 6A to 6D are omitted in FIG. 7 and FIGS. 8A and 8B.

In FIG. 8A, the first and fourth switch units 511 and 522 are turned on. Hence, a current path ① passing through the first constant voltage source 600, the first switch unit 511, and the fourth switch unit 522 is formed. The first voltage V1 is supplied to the address electrode along the current path ①.

In FIG. 8B, the first switch unit 511 remains in a turn-on state and the third switch unit 521 is turned on. Hence, a current path ② passing through the first constant voltage source 600, the first switch unit 511, the second constant voltage source 700, and the third switch unit 521 is formed. A highest voltage of the data signal corresponding to a sum of the first voltage V1 and the second voltage V2 is supplied to the address electrode along the current path ②.

In FIG. 7 and FIGS. 8A and 8B, a low voltage is supplied to the address electrode in a state of the supply of a low voltage to the address electrode to generate an address discharge. Since the reason and effect of the supply of the low voltage were explained, the description thereof is omitted.

While FIG. 7 and FIGS. 8A and 8B have illustrated and described the data signal changing from the state of the maintenance of the first voltage V1 to a sum of the first and second voltages V1 and V2, it is not limited thereto. The first voltage V1 may be substantially equal to the second voltage V2.

The plurality of second data drivers 520 may be formed so as to operate the above-described waveform and the current path, and the plurality of first data drivers 510 corresponding to the plurality of second data drivers 520 may be formed.

The number of second data drivers 520 which are electrically connected to the address electrodes and supply the data signal to the address electrodes may be equal to the number of address electrodes. The number of first data drivers 510 may be equal to the number of second data drivers 520, and may be one.

In case that the n second data drivers 520 (where n is a natural number greater than 2) are formed and the n second data drivers 520 are connected to the n first data drivers 510, respectively, the data signal can be more stably produced.

In case that one first data driver 510 is formed and the n second data drivers 520 are commonly connected to one first data driver 510, the manufacturing cost can be reduced due to a reduction in the number of switch units.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display system comprising:

a first voltage source connected to a first driver, the first voltage source configured with a first terminal and a second terminal, the second terminal of the first voltage source connected to a circuit terminal having a fixed potential;

a second voltage source connected to a second driver and to the first driver, the second voltage source configured with a third terminal and a fourth terminal;

an electrode connected to the second driver;

the first driver configured to output a first driving voltage to the fourth terminal of the second voltage source, the first driver comprising:

a first electrical switch connected to the first terminal of the first voltage source, the first electrical switch configured to output the first driving voltage, a first level shifter connected to the first electrical switch, the first level shifter configured to control the output of the first driving voltage, and a second electrical switch connected to the second terminal having the fixed potential, the second electrical switch configured to output the fixed potential for the first driving voltage; and the second driver configured to output a second driving voltage to the electrode, the second driver comprising:

a third electrical switch connected to the third terminal of the second voltage source, the third electrical switch configured to output the second driving voltage, a second level shifter connected to the third electrical switch, the second level shifter configured to control the output of the second driving voltage, a fourth electrical switch, connected directly to the fourth terminal of the second voltage source, the third electrical switch configured to output the second driving voltage, and a third level shifter connected to the fourth electrical switch, the third level shifter configured to control the output of the second driving voltage.

2. The system of claim 1, wherein the fixed potential comprises a ground level voltage.

3. The system of claim 1, wherein the first electrical switch is directly connected to the first terminal of the first voltage source, and the third electrical switch is directly connected to the third terminal of the second voltage source.

4. The system of claim 1, wherein the second level shifter is connected to the third level shifter in a stacked configuration.

5. The system of claim 1, wherein the second driver is configured to output the second driving voltage as voltage steps.

6. The system of claim 1, wherein:

the first level shifter is configured to control the first electrical switch, the second level shifter is configured to control the third electrical switch, and the third level shifter is configured to control the fourth electrical switch.

7. The system of claim 1, wherein the first voltage source is configured to output a voltage greater than an output voltage of the second voltage source.

8. The system of claim 1, wherein the first voltage source is configured to output a voltage in a first range of 35 V to 45 V, and the second voltage source is configured to output a voltage in a second range of 25 V to 35 V.

9. A method for driving a plasma display, the method comprising:

generating a first voltage from a first voltage source;

generating a second voltage from a second voltage source;

receiving, at a first driver, the first voltage;

generating, at the first driver, a first output voltage based on the first voltage;

receiving, at a second driver, the first output voltage and the second voltage;

generating, at the second driver, a second output voltage based on the first output voltage and the second voltage; and sending the second output voltage to an electrode, wherein the first driver comprises circuits configured to generate the first output voltage in increments of voltage step levels, and wherein the second driver comprises circuits configured to generate the second output voltage in increments of voltage step levels.

10. The method of claim 9, wherein the first voltage source is configured to output a voltage greater than an output voltage of the second voltage source.

11. The method of claim 9, wherein the first voltage source is configured to output a voltage in a first range of 35 V to 45 V, and the second voltage source is configured to output a voltage in a second range of 25 V to 35 V.

12. A device configured for driving a plasma display comprising:

a first driver configured to output a first driving voltage to a second driver, the first driver comprising:

a first electrical switch connected to a first terminal, the first terminal associated with a first voltage source, the first electrical switch configured to output the first driving voltage, a first level shifter connected to the first electrical switch, the first level shifter configured to control the output of the first driving voltage, and a second electrical switch connected to a second terminal having the fixed potential, the second electrical switch configured to output the fixed potential for the first driving voltage; and the second driver configured to output a second driving voltage to an output terminal, the second driver comprising:

a third electrical switch connected to a third terminal, the third terminal associated with a second voltage source, the third electrical switch configured to output the second driving voltage, a second level shifter connected to the third electrical switch, the second level shifter configured to control the output of the second driving voltage, a fourth electrical switch, connected directly to a fourth terminal, the forth terminal associated with a second voltage source, the third electrical switch configured to output the second driving voltage, and a third level shifter connected to the fourth electrical switch, the third level shifter configured to control the output of the second driving voltage.

13. The device of claim 12, wherein the fixed potential comprises a ground level voltage.

14. The device of claim 12, wherein the first electrical switch is directly connected to the first terminal, and the third electrical switch is directly connected to the third terminal.

15. The device of claim 12, wherein the second level shifter is connected to the third level shifter in a stacked configuration.

16. The device of claim 12, wherein the second driver is configured to output the second driving voltage as voltage steps.

17. The device of claim 12, wherein:

the first level shifter is configured to control the first electrical switch, the second level shifter is configured to control the third electrical switch, and the third level shifter is configured to control the fourth electrical switch.

18. The device of claim 12, wherein the first voltage source is configured to output a voltage greater than an output voltage of the second voltage source.

19. The device of claim 12, wherein the first voltage source is configured to output a voltage in a first range of 35 V to 45 V, and the second voltage source is configured to output a voltage in a second range of 25 V to 35 V.

* * * * *